US007762018B1

(12) United States Patent
Fitzpatrick et al.

(10) Patent No.: US 7,762,018 B1
(45) Date of Patent: Jul. 27, 2010

(54) MODULAR GUNSTOCK

(75) Inventors: Richard M. Fitzpatrick, Denver, CO (US); Michael T. Mayberry, Denver, CO (US); Eric S. Nakayama, Broomfield, CO (US); Brian L. Nakayama, Arvada, CO (US)

(73) Assignee: Magpul Industries Corp., Erie, CO (US)

( * ) Notice: Subject to any disclaimer, the term of this patent is extended or adjusted under 35 U.S.C. 154(b) by 356 days.

(21) Appl. No.: 12/028,758

(22) Filed: Feb. 8, 2008

Related U.S. Application Data

(60) Provisional application No. 60/889,244, filed on Feb. 9, 2007.

(51) Int. Cl.
*F41C 23/14* (2006.01)

(52) U.S. Cl. ..... 42/73

(58) Field of Classification Search ..... 42/71.01, 42/72–74, 75.01, 75.02, 75.03
See application file for complete search history.

(56) References Cited

U.S. PATENT DOCUMENTS 3,137,958 A * 6/1964 Lewis et al. ..... 42/73
3,348,328 A * 10/1967 Roy ..... 42/73
5,173,564 A * 12/1992 Hammond, Jr. ..... 42/75.03
6,553,707 B1 * 4/2003 Tseng ..... 42/72
6,560,911 B2 * 5/2003 Sharp ..... 42/73
6,637,141 B1 * 10/2003 Weatherby et al. ..... 42/75.03
6,651,371 B2 * 11/2003 Fitzpatrick et al. ..... 42/72
6,688,031 B2 * 2/2004 Steele ..... 42/73
6,779,289 B2 * 8/2004 Kay ..... 42/75.03
7,152,355 B2 * 12/2006 Fitzpatrick et al. ..... 42/73
7,162,822 B1 * 1/2007 Heayn et al. ..... 42/73
7,398,616 B1 * 7/2008 Weir ..... 42/73
7,428,794 B2 * 9/2008 Oz ..... 42/73
2004/0016167 A1 * 1/2004 Fitzpatrick et al. ..... 42/71.01
2004/0255505 A1 * 12/2004 Fitzpatrick ..... 42/72
2006/0010749 A1 * 1/2006 Kincel ..... 42/71.01
2006/0096146 A1 * 5/2006 Fitzpatrick et al. ..... 42/71.01
2007/0261284 A1 * 11/2007 Keng ..... 42/73

* cited by examiner

*Primary Examiner*—Bret Hayes
*Assistant Examiner*—Reginald Tillman, Jr.
(74) *Attorney, Agent, or Firm*—Geoffrey E. Dobbin

(57) ABSTRACT

The present invention is a modular gunstock utilizing a two-piece mounting structure and a stock module. The structure comprises a weapon attachment, in the case of an AR15/M16 rifle a receiver extension tube, and a sleeve slidable over said attachment and containing mounting structure for the stock module. The disclosed stock module is adjustable for length and features a length pre-set system, a latch with independent dual-pawls and an integrated impact buffer, modular tail-piece, and storage. The sleeve also features a position selectable fixed cheek plate.

8 Claims, 16 Drawing Sheets

MODULAR GUNSTOCK

CROSS-REFERENCES TO RELATED APPLICATIONS

This Application claims priority on prior filed U.S. Provisional Application No. 60/889,244, filed Feb. 9, 2007 and incorporates the same by reference in its entirety.

FIELD OF THE INVENTION

The present invention relates to the field of firearms and more particularly relates to a gunstock with enhanced modularity and adjustment functions.

BACKGROUND OF THE INVENTION

Gunstocks or "buttstocks" as they are commonly known, are well known in the art of firearms. These devices have been used with "long arms" as a means for resting and securing the weapon against the shoulder of the user when firing. Gunstocks have also been used as a weapon in and of themselves in a melee fight. As such, gunstocks have been developed along many different shapes and designs and using various materials to increase durability, reduce the effects of recoil, or "kick", provide adjustability and customization, increase shooter accuracy, provide storage for gear, and other goals too myriad to mention.

One recent goal, however, is to provide a modular gunstock such that a single stock, or portion of a stock, may be used as a platform upon which user customizations may be mounted. However, previous modular gunstocks present a number of difficulties. The first of which is that the mounting components for such systems tends to be bulky, as they contain additional mounting features not present in other stocks. Second, a structural failure in a mounting component tends to render the weapon useless until a costly part is replaced. As such, a new modular gunstock is needed that presents a lower profile, with a simpler mounting paradigm, and is cost effective to replace in the event of structural failure.

The present invention is a modular gunstock that provides a two-piece mounting platform as a new modular paradigm. The present invention represents a departure from the prior art in that the modular gunstock of the present invention allows for a durable two-piece mounting platform upon which stock options may be mounted. As a two-piece platform, the design draws upon the inherent strength of having two or more pieces working on concert, a layering approach, and also allows for the replacement of one of such pieces should either fail with lesser cost both to the user and the manufacturer.

The present invention is described as a preferred embodiment with an adjustable for length stock attachment. Particular problems with such systems include lack of stability, insufficient strength, and cheek weld disruption where the pieces join.

SUMMARY OF THE INVENTION

In view of the foregoing disadvantages inherent in the known types of modular gunstocks, this invention provides a new modular gunstock utilizing a two-piece mounting platform. As such, the present invention's general purpose is to provide a new and improved modular gunstock that is durable, lower cost and achieves the goal of modular customization with greater efficiency. To these ends, the modular gunstock comprises a receiver extension tube, or "buffer tube", upon which a sleeve is slid into place and secured to the tube by conventional means. The sleeve has on its external surface mounting hardware for the remainder of the stock, in the form of a rail. Other hardware is provided to provide interface with the remainder of the weapon. Since the modular gunstock is primarily mounted upon a buffer tube, it presents an instant advantage over prior modular systems and earlier carbine systems as previous systems had to be "timed" to properly engage the receiver with their interface when screwed into the receiver. This modular system required no such estimation. It should be noted that the gunstock as depicted is for a U.S. standard M-16/AR-15 style rifle. However, it should be appreciated that other weapon platforms which use a gunstock will benefit from the present invention and that the only changes necessary will be in the interface of the stock with the weapon. As such, such changes should be read into and considered as a within the scope of this invention.

Other features of this gunstock, as disclosed in the preferred embodiment, include an adjustable for length stock with a quick extension pre-set system and a dual, independent pawl latch. The adjustable for length stock also features a shock cushion for the latching mechanism, so as to minimize kick and bludgeon shock to the latch, a storage compartment, a modular tail-piece and a customizable fixed cheek piece. It should also be appreciated that this disclosure is only describing one possible stock module to interface with the system that is the invention. Other stock types, including fixed stocks and precision shooting stocks, may be manufactured for this system and still be considered within the scope of this invention.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, the preferred embodiment of the modular gunstock is herein described. It should be noted that the articles "a", "an", and "the", as used in this specification, include plural referents unless the content clearly dictates otherwise.

Figure 1:
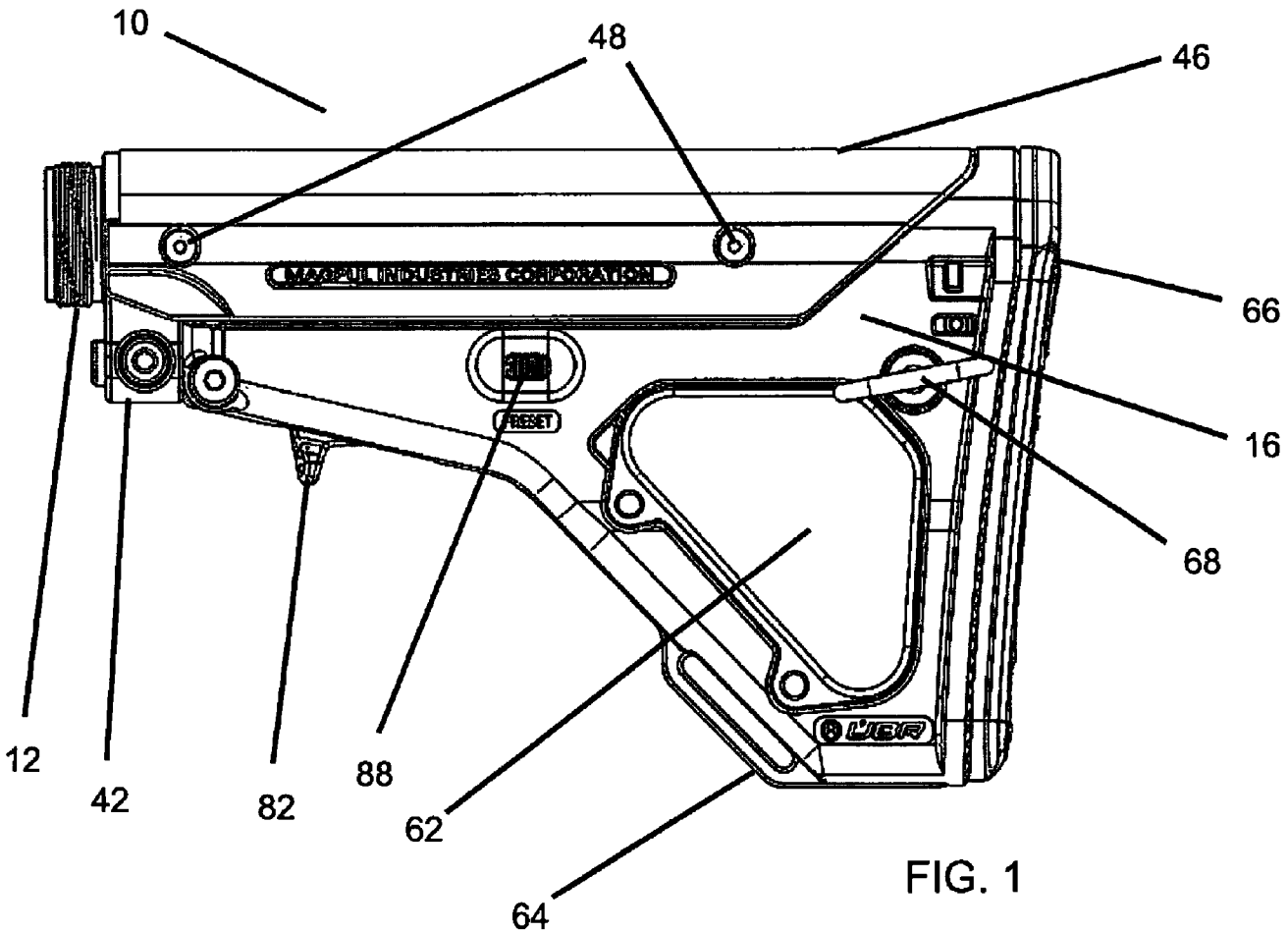
FIG. 1 is a left plan view of the gunstock using an adjustable for length stock module.
Figure 2:
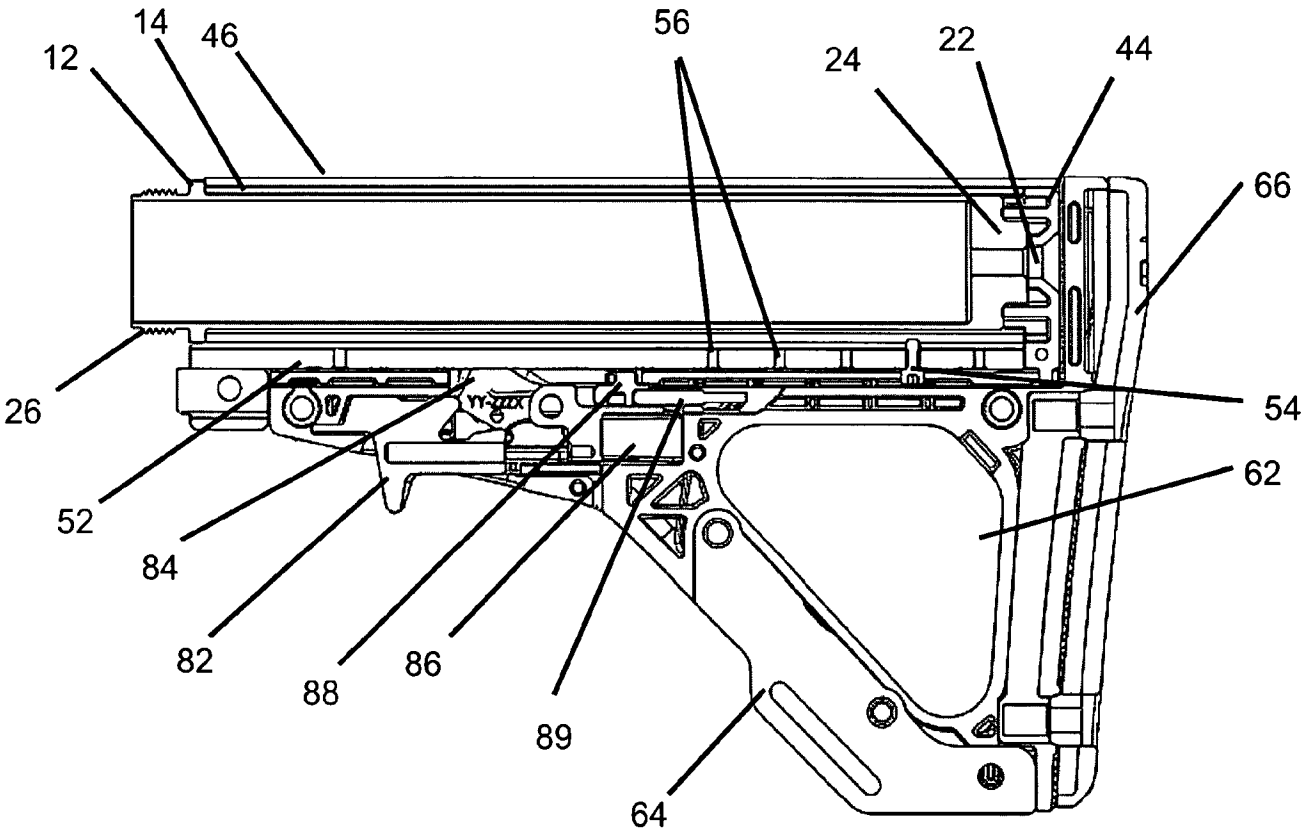
FIG. 2 is a cross-sectional view of the stock of FIG. 1.
Figure 3:
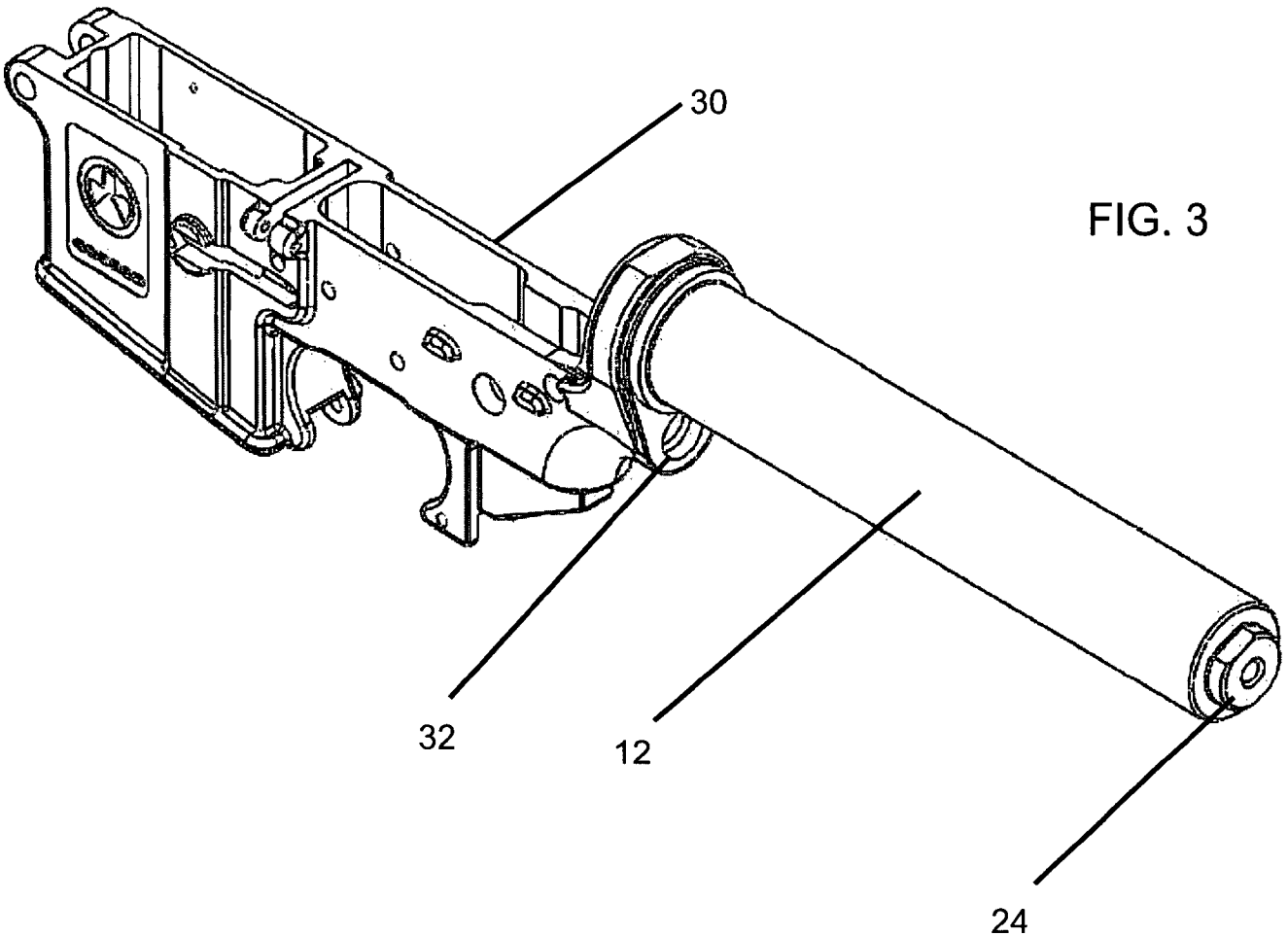
FIG. 3 is a perspective view of the gunstock's extension tube module installed on an AR-15 lower receiver.

With reference to FIGS. 1 and 2, the modular gunstock comprises three main components. The first is a weapon mounting structure 12 which is the actual attachment to the weapon (See, FIG. 3). In the case of an AR15/M16 model weapon, the structure is actually a replacement receiver extension tube. However the only requirement is that the mounting structure 12 be cylindrical (either round or polygonal) so that sleeve module 14 may slide over it. As such, references to the mounting structure 12 as being an extension tube should be construed as only relating to this preferred and disclosed embodiment as alteration of the structure for other weapon platforms that do not need a receiver extension tube will be obvious permutations of the present invention and should be read as included within this invention. Weapon mounting structure features actual interfacing structure, in the case of this preferred embodiment a threaded open end 26, and a threaded nut 24 at its distal end. The preferred embodiment then simply screws onto the weapon's lower receiver 30, shown in FIG. 3. It should be noted that the key slot 32 is avoided by the invention at this stage.

Figure 4:
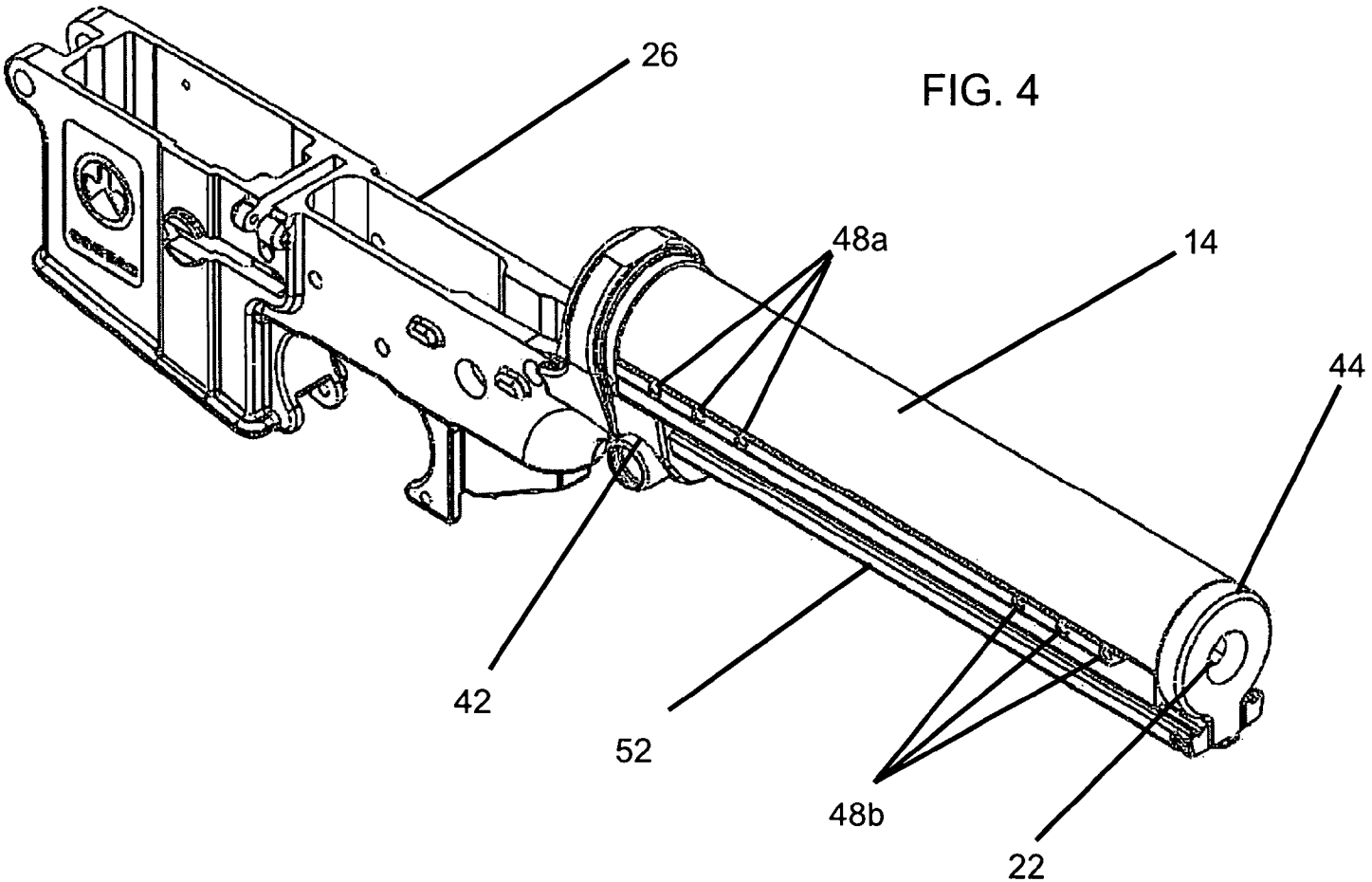
FIG. 4 is a perspective view depicting the gunstock's sleeve module installed.

The second component is the sleeve module 14, which slides over the mounting module 12, shown in FIGS. 2 and 4. ON the lower half of sleeve module 14, is rail 52 which serves as structure for the stock body. Rail also provides interface structure for yoke 42 and end cap 44. End cap 44 is attached and keyed into sleeve 14 between two prongs of rail 52. Bolt 22 is then used to secure end cap 44 to threaded nut 24 on the mounting structure 12. Sleeve 14 is thereby secured to mounting structure 12 in a manner that prevents rotation. Yoke 42 is positioned at a forward end of sleeve 14, on rail 52. It provides structure 41 to key into the receiver's key slot 32, thereby preventing rotation in relation to lower receiver 30. Yoke 42 is secured as a vice, biased by bolt 43, and may provide additional useful structure as a quick-detach point for certain accessories such as slings.

Sleeve module 14 also features a plurality of sets of threaded holes 48*a*, 48*b* along its sides. These holes provide mounting structure for cheek plate 46, as it is secured by threading bolts 48 into one of each set 48*a*, 48*b* of holes, depending on the location the user desires the cheek plate 46, as shown. It should be understood that matching sets of holes are ideally placed on the side not shown in the figures. As shown, the sleeve module 14 provides three placement options for positioning the cheek plate 46.

Figure 5:
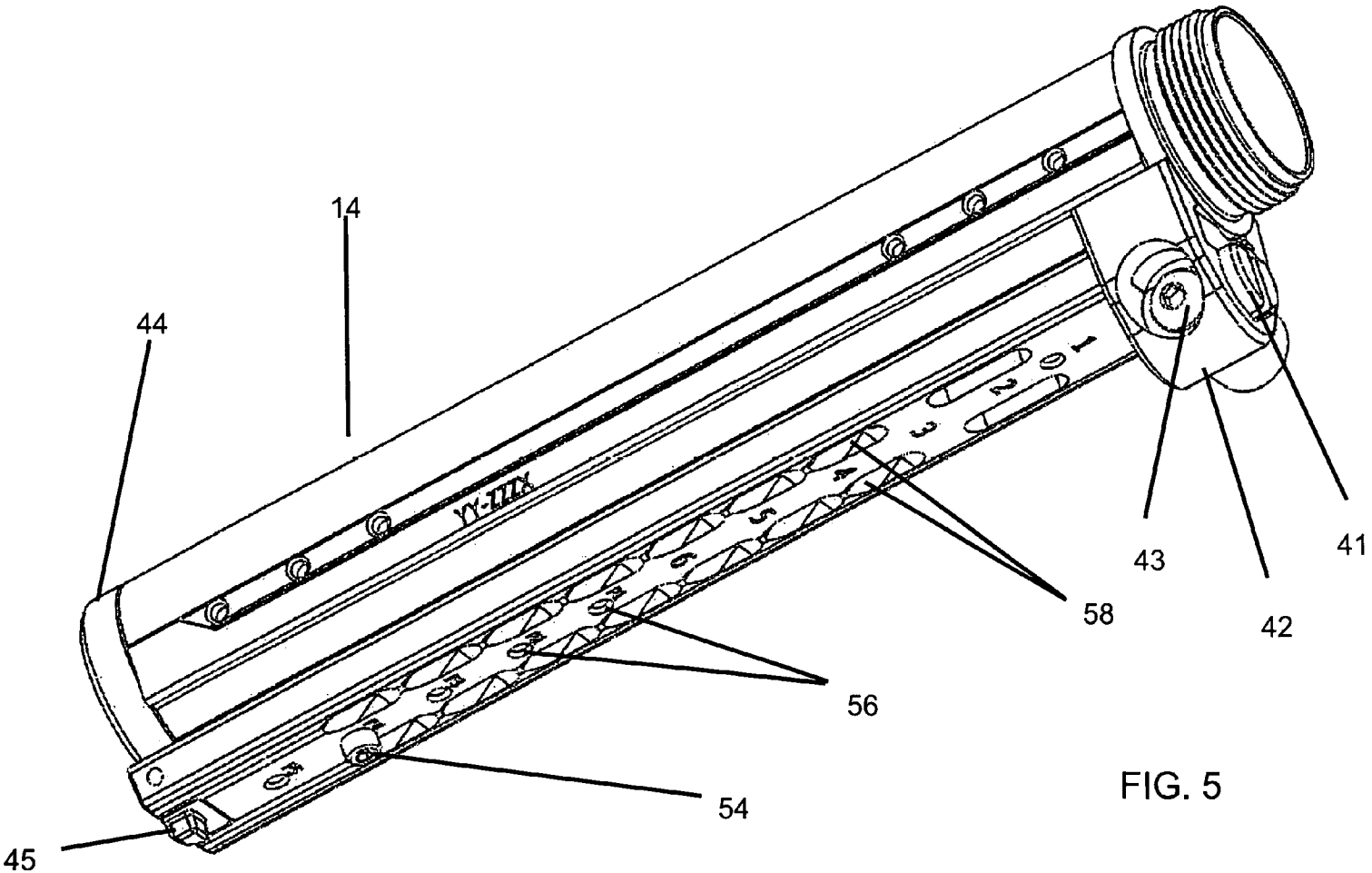
FIG. 5 is a perspective view of the assembled mounting structure's underside.
Figure 6B:
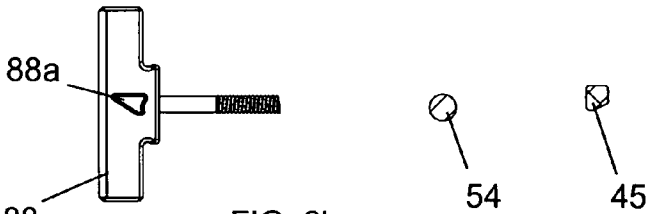
FIG. 6*b* is a sectional view, taken along line B-B of FIG. 6.
Figure 6C:
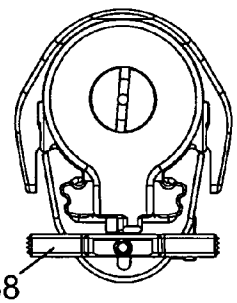
FIG. 6*c* is a rear plan view of the system depicted in FIG. 6.
Figure 6:
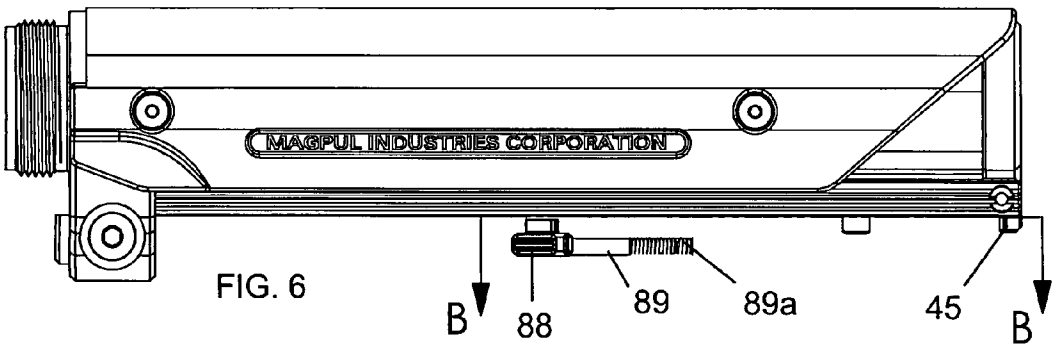
FIG. 6 is a right plan view of the assembled mounting and the length of pull preset system, taken when the stock (not shown) is in a collapsed position.
Figure 6A:
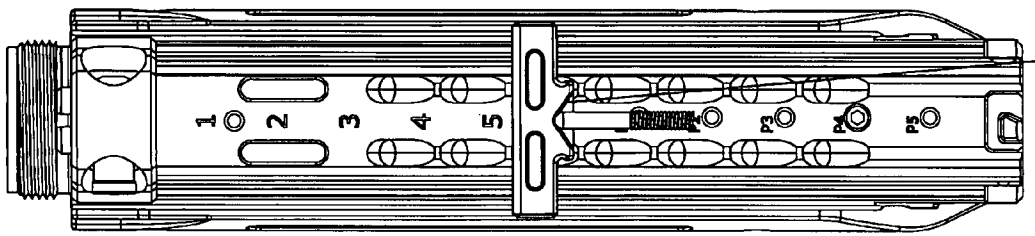
FIG. 6*a* is a bottom plan view of the system depicted in FIG. 6.

Rail 52, shown in FIG. 5, provides structure for mounting the stock body and contains structure for the pre-set system utilized by stock bodies which are adjustable for length. The length of pull system comprises a series of pre-drilled threaded holes 56, which are off-set from a center axis of the rail (shown in better detail in FIG. 6*a*). A stop bolt 54 is provided to interface with whichever hole 56 a user desires. End cap 44 also provides a terminal stop 45, which is also off-set but opposite holes 56. Angled detents 58 are provided for pawls in the latch mechanism.

Figure 7B:
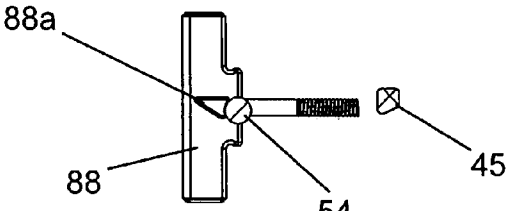
FIG. 7*b* is a sectional view, taken along line B-B of FIG. 7.
Figure 7C:
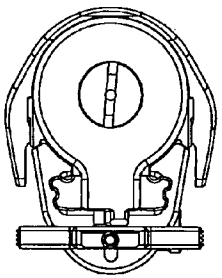
FIG. 7*c* is a rear plan view of the system depicted in FIG. 7.
Figure 7:
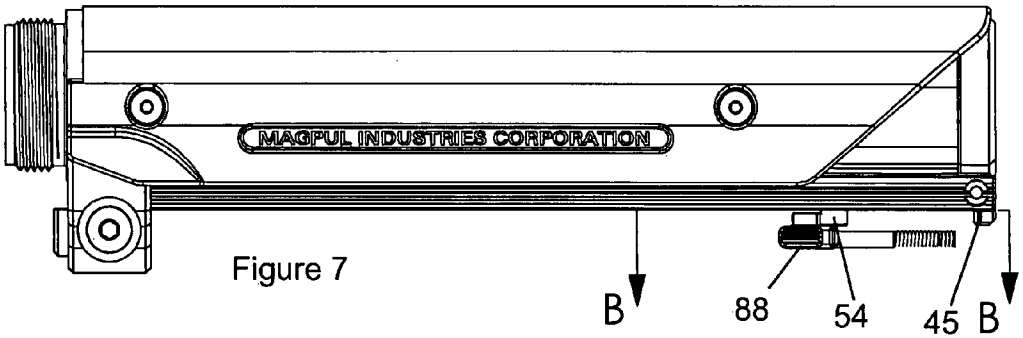
FIG. 7 is a right plan view of the assembled mounting and the length of pull preset system, taken when the stock (not shown) is in an extended to the pre-set position.

The length of pull pre-set system works as follows, shown in FIGS. 6-12*c*. The stock is in a normal state, shown in FIGS. 6-6*c*, where a stop bolt 54 is inserted in one threaded hole 56 and the terminal stop 45 is in place. Release latch 88 is situated just underneath the rail and is biased in a central orientation by plunger 89, which is so biased by spring 89*a*. On top of release latch 88, is an angled block 88*a* which will interface with stop bolt 54 and terminal stop 45. In FIGS. 7-7*c*, the stock is depicted as having been extended (moved back) until the block 88*a* abuts stop bolt 54. As can be seen, the wide portion of the angled block 88*a* actually abuts the stop bolt 54 and prevents the stock from being further retracted. However, it should be noted that if the release latch was on the other side of the stop bolt 54, the angled portion of the block 88*a* would interface with the stop bolt 54 (if being pushed forward) and would actually act as a lever, moving the release latch 88 out of the way so that the stock could be collapsed without engaging the release latch 88.

Figure 7A:
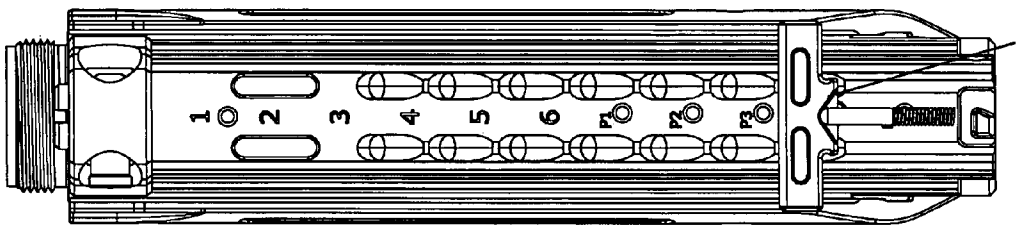
FIG. 7*a* is a bottom plan view of the system depicted in FIG. 7.
Figure 8B:
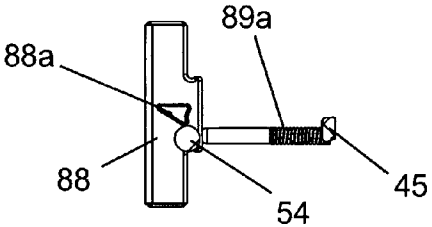
FIG. 8*b* is a sectional view, taken along line B-B of FIG. 8.
Figure 8A:
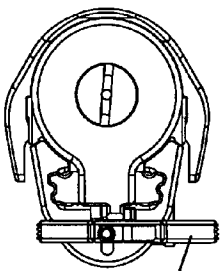
FIG. 8*a* is a bottom plan view of the system depicted in FIG. 8.
Figure 8:
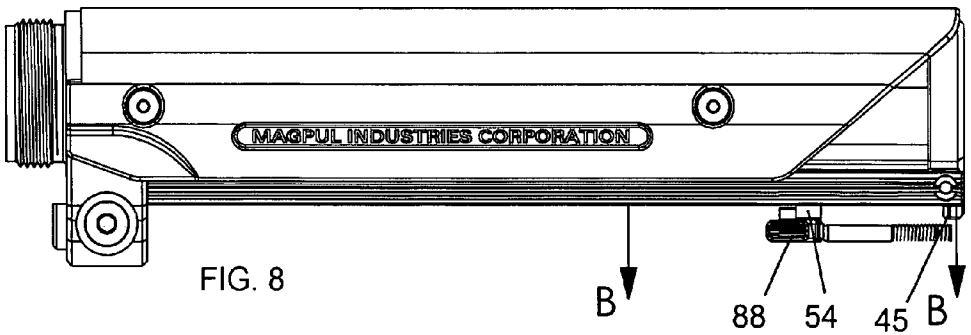
FIG. 8 is a right plan view of the assembled mounting and the length of pull preset system, taken when the stock (not shown) is in an extended to the pre-set position and the release latch is biased to avoid the pre-set.
Figure 8C:
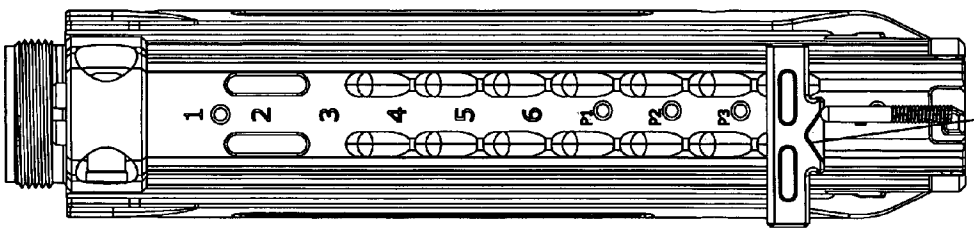
FIG. 8*c* is a rear plan view of the system depicted in FIG. 8.
Figure 9B:
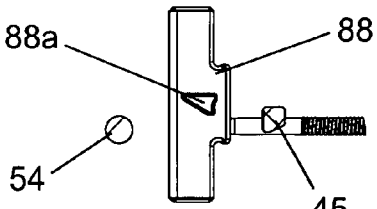
FIG. 9*b* is a sectional view, taken along line B-B of FIG. 9.
Figure 9C:
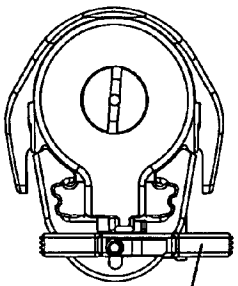
FIG. 9*c* is a rear plan view of the system depicted in FIG. 9.
Figure 9:
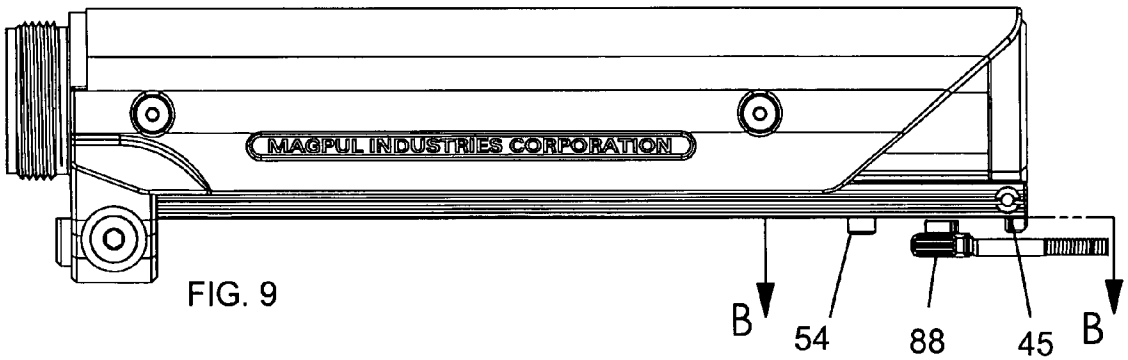
FIG. 9 is a right plan view of the assembled mounting and the length of pull preset system, taken when the stock (not shown) is in a position between the pre-set and the end stop, maintaining the latch bias of FIG. 8.
Figure 9A:
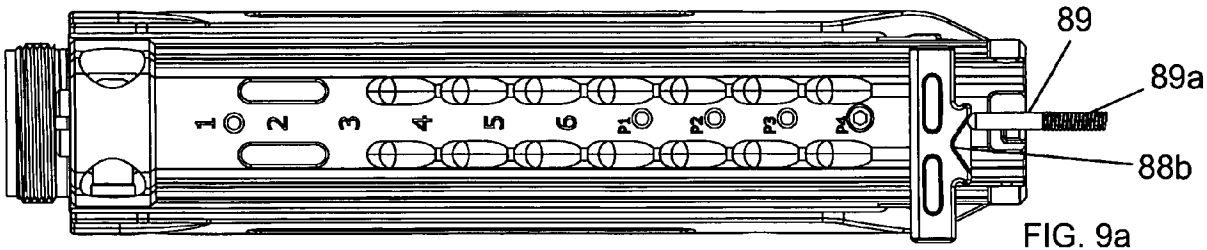
FIG. 9*a* is a bottom plan view of the system depicted in FIG. 9.
Figure 10B:
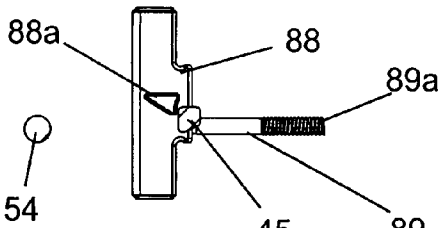
FIG. 10*b* is a sectional view, taken along line B-B of FIG. 10.
Figure 10C:
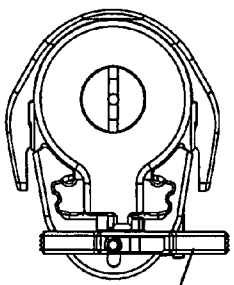
FIG. 10*c* is a rear plan view of the system depicted in FIG. 10.
Figure 10:
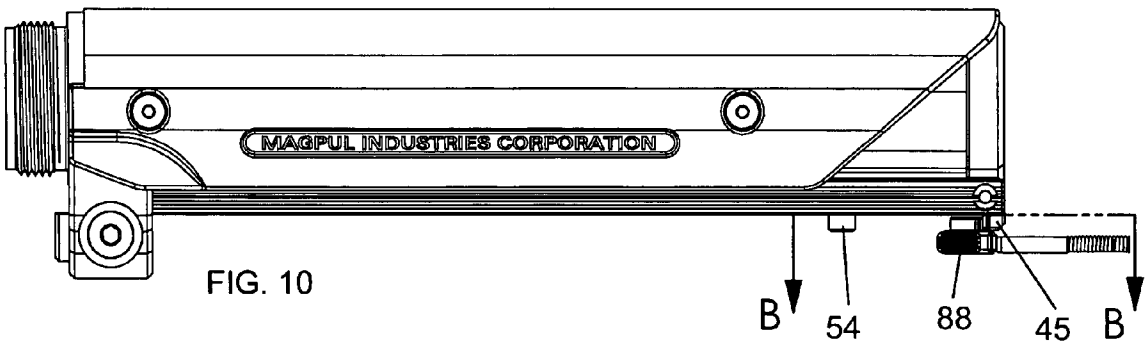
FIG. 10 is a right plan view of the assembled mounting and the length of pull preset system, taken when the stock (not shown) is in an extended position to the end stop, maintaining the latch bias of FIG. 8.
Figure 10A:
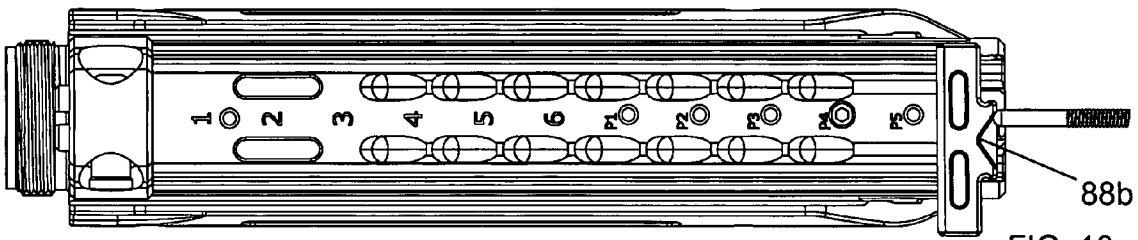
FIG. 10*a* is a bottom plan view of the system depicted in FIG. 10.
Figure 11B:
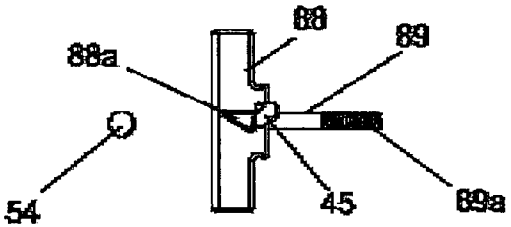
FIG. 11*b* is a sectional view, taken along line B-B of FIG. 11.
Figure 11C:
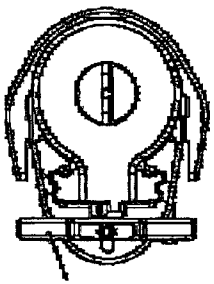
FIG. 11*c* is a rear plan view of the system depicted in FIG. 11.
Figure 11:
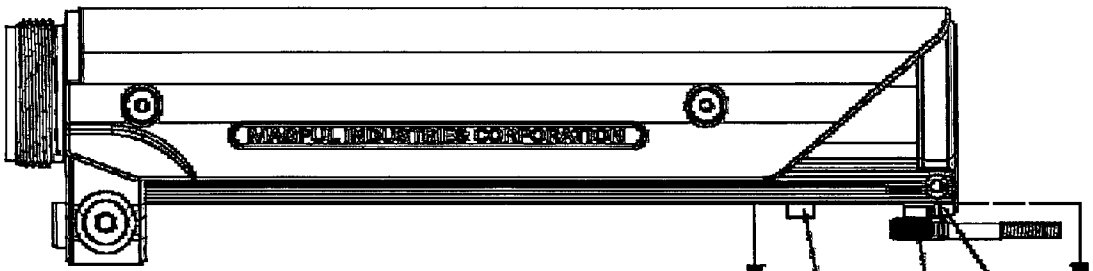
FIG. 11 is a right plan view of the assembled mounting and the length of pull preset system, taken when the stock (not shown) is in an extended position to the end stop, releasing the latch bias of FIG. 8.
Figure 11A:
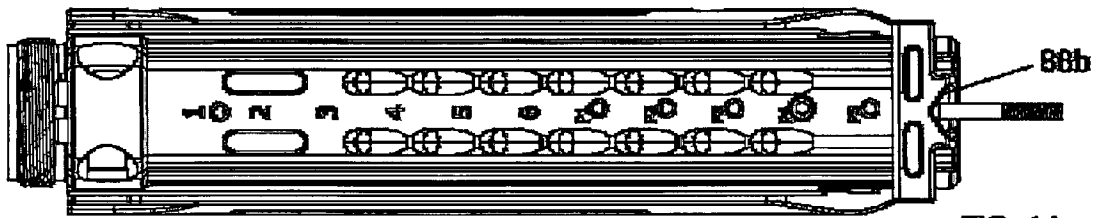
FIG. 11*a* is a bottom plan view of the system depicted in FIG. 11.
Figure 12B:
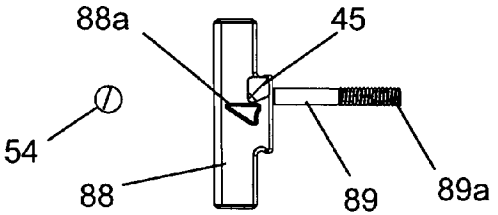
FIG. 12*b* is a sectional view, taken along line B-B of FIG. 12.
Figure 12C:
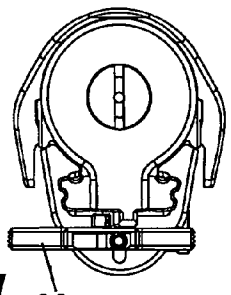
FIG. 12*c* is a rear plan view of the system depicted in FIG. 12.
Figure 12:
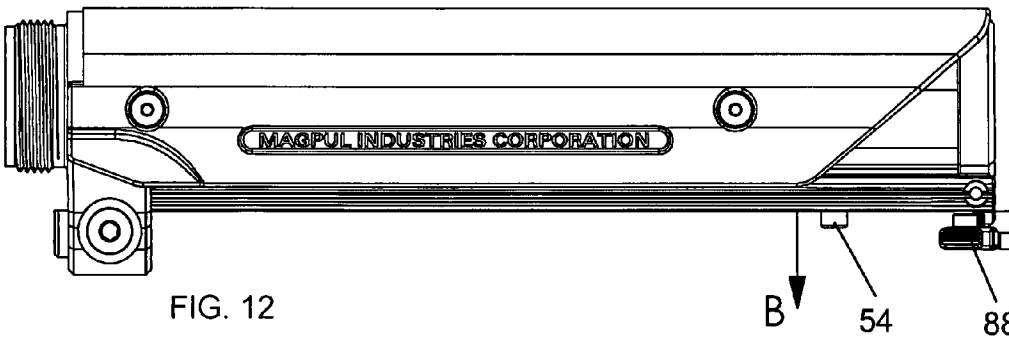
FIG. 12 is a right plan view of the assembled mounting and the length of pull preset system, taken when the stock (not shown) is in an extended position to the end stop, reversing the latch bias of FIG. 8.
Figure 12A:
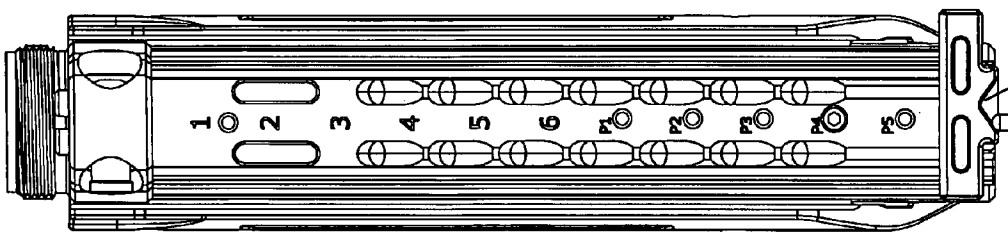
FIG. 12*a* is a bottom plan view of the system depicted in FIG. 12.

In order to avoid the stop bolt 54, the user presses the release latch 88 to one side (FIGS. 8-8*c*). As the block 88*a* circumvents the stop bolt 54, the stock may be retracted further (FIGS. 9-9*c*) without hindrance, until it reaches the point of terminal stop 45 (FIGS. 10-10*c*). It should be noted that in both its natural stage (FIGS. 11-11*c*) and the biased stage (FIGS. 10-10*c*), the block 88*a* interfaces with the terminal stop 45. Instead, to avoid the terminal stop 45, the release latch 88 must be biased in the opposite direction as to avoid the bolt stop 54. This is done intentionally so as to avoid accidental removal of the stock from the system which only trying to avoid the bolt stop 54. The release latch 88 maintains its central bias via spring loaded plunger 89 which interfaces with a "V" shaped notch 88*b* on the underside of the release latch 88. When the release latch 88 is biased to one side or the other by the user, plunger 89 is displaced by the walls of notch 88*b* and spring 89*a* is compressed (FIGS. 8*a*, 9*a*, 10*a*, 12*a*). When the bias is released, spring 89*a* decompresses, forcing plunger 89 forward and restoring release latch 88 to its central orientation (FIGS. 6*a*, 7*a*, 11*a*) by pressure against the notch 88*b*.

Figure 13:
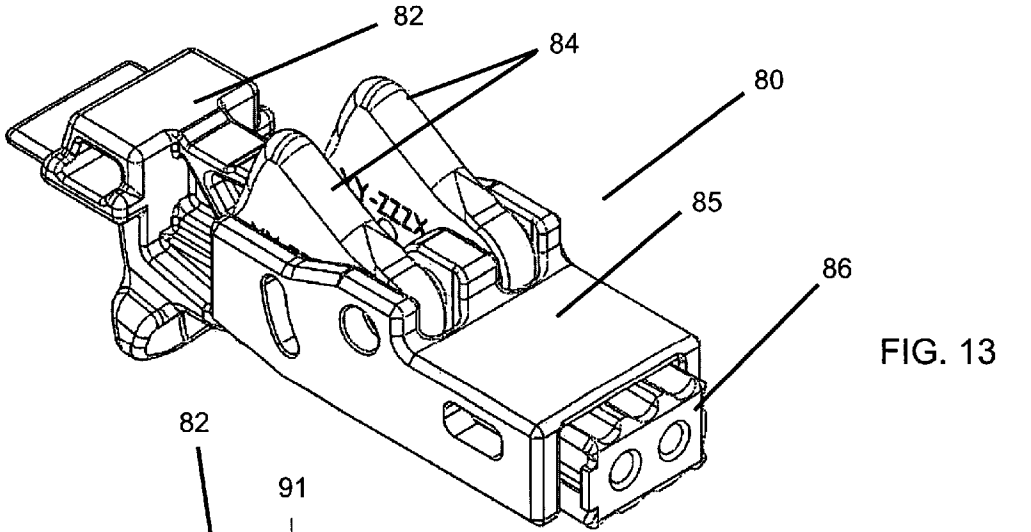
FIG. 13 is a perspective view of the latch mechanism for the stock, according to the present invention.
Figure 13B:
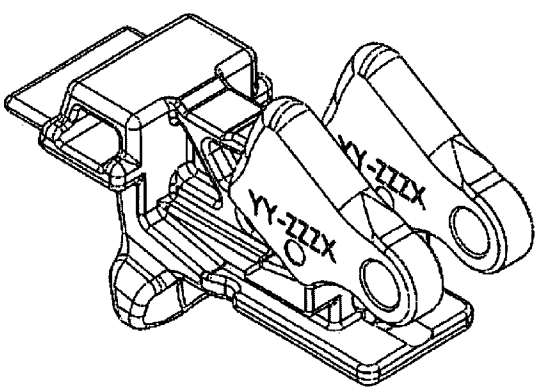
FIG. 13*b* is a perspective view of the trigger mechanism and pawls for the latch of FIG. 13.
Figure 13A:
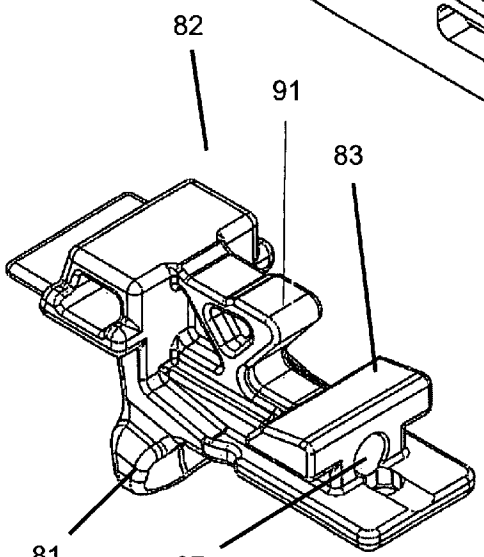
FIG. 13*a* is a perspective view of the trigger mechanism of the latch depicted in FIG. 13.
Figure 14:
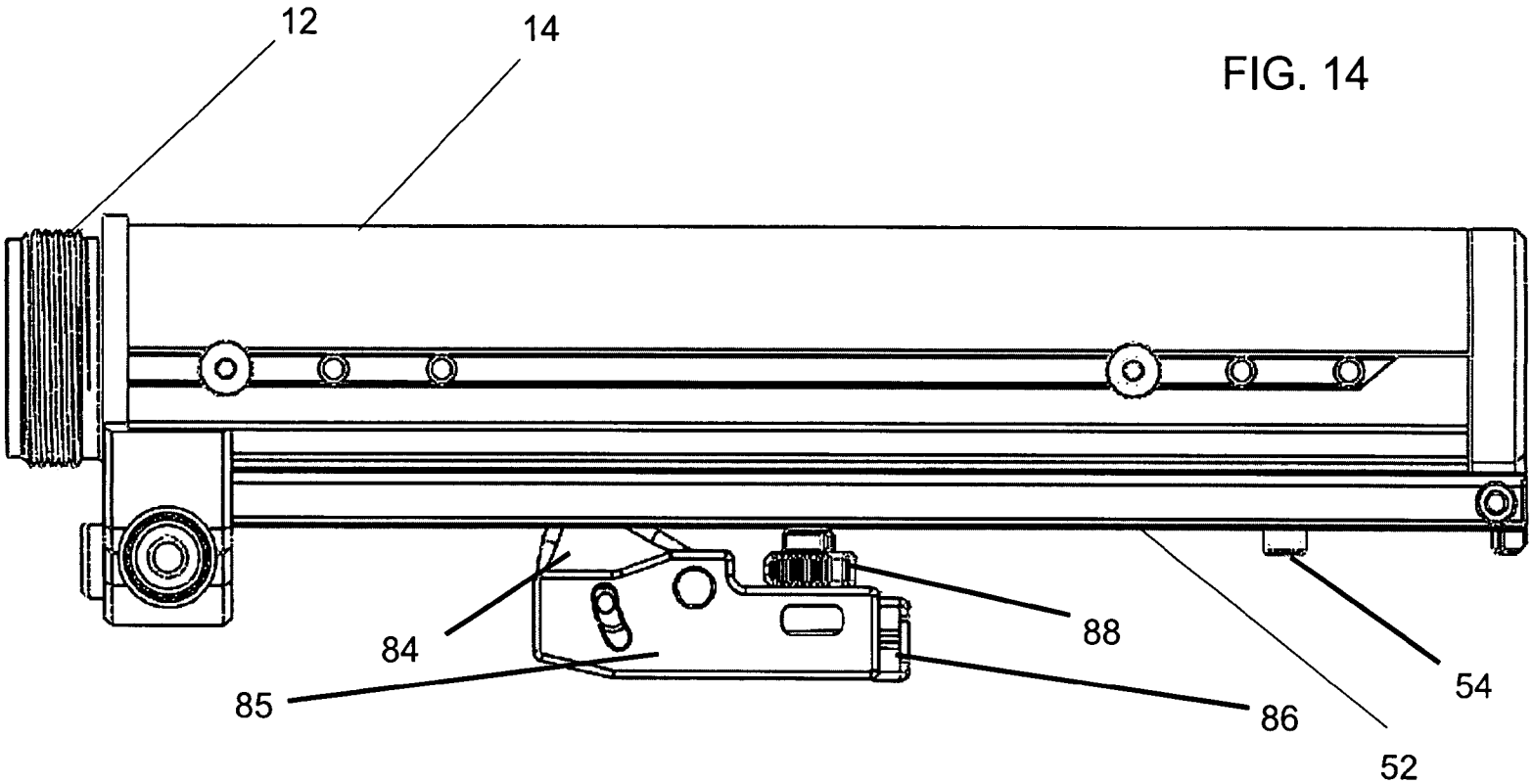
FIG. 14 is a left plan view of the mounting structure, sleeve module, and latch mechanism, without trigger, of the invention.
Figure 15:
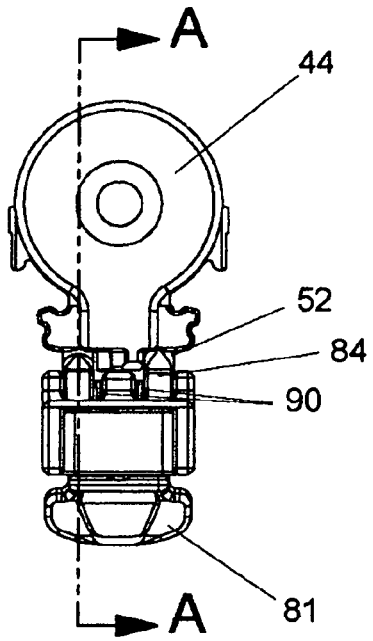
FIG. 15 is a rear plan view of the mounting structure, sleeve module and latch mechanism in a locked state.
Figure 16:
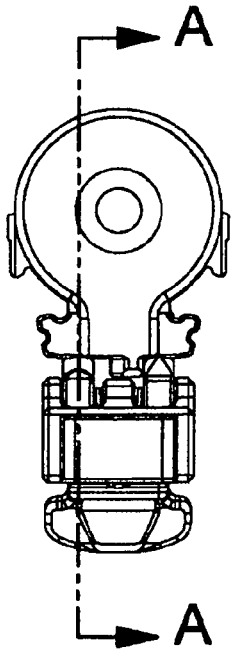
FIG. 16 is a rear plan view of the mounting structure, sleeve module and latch mechanism in an intermediate state.
Figure 17:
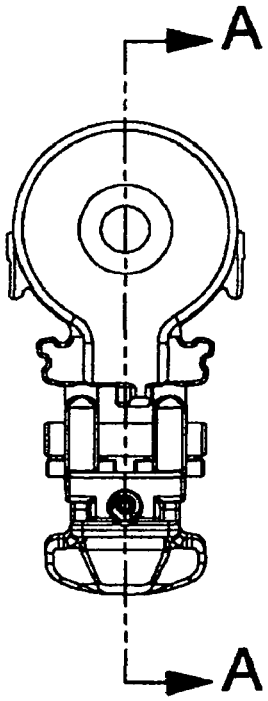
FIG. 17 is a rear plan view of the mounting structure, sleeve module and latch mechanism in an unlocked state.
Figure 17A:
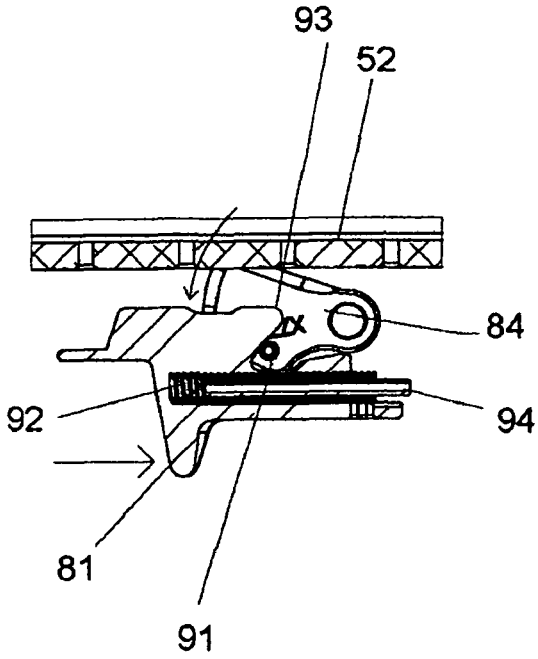
FIG. 17*a* is a partial sectional view of the system depicted in FIG. 17, taken along line A-A.

The latching mechanism is depicted in FIGS. 13-17*a*. As seen in FIGS. 13-13*b*, the latch components are the latch housing 85, which contains the shock cushion 86 and trigger structure 82. Lock pawls 84 are mounted on the top of the housing 85. Lock pawls 84 are biased by springs 90 (FIGS. 15 & 16) in an upward orientation. Trigger structure is also spring biased in an extended position by latch spring 92, mounted upon post 94 in the housing (FIG. 17*a*). Latch spring 92 rests inside orifice 87 in the trigger structure (FIG. 13*a*). Trigger structure comprises the actual trigger body 81 and two bias wedges 83, 93, to actuate lock pawls 84. As shown in FIG. 14, the latch mechanism resides below the rail 52 on the sleeve module 14. Pre-set latch 88 resides between the latch mechanism and the rail 52.

Figure 15A:
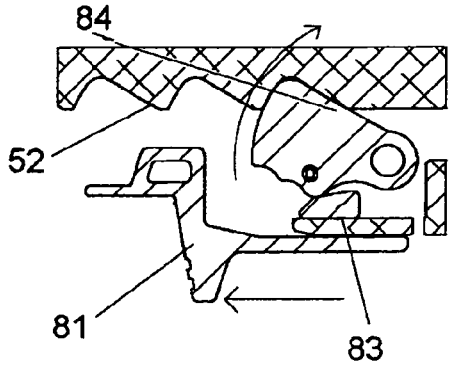
FIG. 15*a* is a partial sectional view of the system depicted in FIG. 15, taken along line A-A.
Figure 16A:
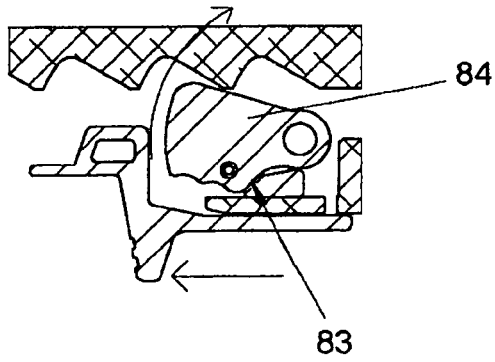
FIG. 16*a* is a partial sectional view of the system depicted in FIG. 16, taken along line A-A.

In operation, the latch is usually in its locked position, shown in FIGS. 15 and 15*a*, with lock pawls 84 resting within detents in the rail 52. Lower wedge 83 provides a mechanical stop to prevent the lock pawls 84 from accidentally being compressed. In intermediate stages, the front slope of the wedge 83 actually provides an assist to effectively and securely move the lock pawls 84 into their locked position (FIGS. 16 and 16*a*). To unlatch the stock (FIGS. 17 and 17*a*), trigger body 81 is compressed against trigger spring 92. This motion causes upper wedge 93 to approach a pawl pin 91 that extends from each pawl 84 and push the pin 91 downward, compressing pawl springs 90 (not shown in FIGS. 17 and 17*a*) and lowering the lock pawls 84. This then allows the stock body to slide transversely along the rail 52, subject to the pre-set system. It should be noted that the lock pawl pins 91 do not join the lock pawls 84 together. The lock pawls 84 operate independently of each other so that failure of one, especially in the open position, may be compensated by the action of the other.

Other features of the stock body, in its preferred embodiment and shown in FIGS. 1 and 2, include a storage compartment 62, formed by having a hollow body enclosed by attachable walls. One of said walls may be capable of opening without removal. The stock also features a removable tailpiece 64. Tailpiece 64 provides structural support and may be designed to protrude from the stock body (as shown in FIG. 2) with a sling loop or with other useful structure, like a glass strike plate. A rubberized butt pad 66 may also be provided to provide some shock absorption when impacts occur, either intentionally or unintentionally. It should be noted that other stock bodies, each with their own set of desirable features, may be designed and used with the described mounting system. As such, no limitation in the claims to the preferred stock body as described herein should be inferred, but only read into the claims where the specific structures of the preferred stock body are directly claimed.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A modular gunstock comprising:

a. a weapon interface structure having a cylindrical profile;

b. a sleeve module slideable upon the cylindrical profile, the sleeve module further comprising interface structure for a stock body;

c. structure to fixedly interface the sleeve module and the interface structure;

d. an adjustable for length stock body with a latching mechanism, the latching mechanism further comprising two independently operated pawls designed to interface with the interface structure for the stock body.

2. The modular gunstock of claim 1, the weapon interface structure being a receiver extension tube.

3. The modular gunstock of claim 2, the structure to fixedly interface the sleeve module and the interface structure being a bolt secured end cap keyed into structure on the sleeve and being secured to the interface structure.

4. The modular gunstock of claim 1, the interface structure for the stock body being a rail, located on the lower half of the sleeve module.

5. The modular gunstock of claim 1, the latch further comprising an impact buffer.

6. The modular stock of claim 1, the stock body further comprising a selectable and replaceable tailpiece.

7. The modular stock of claim 1, the sleeve module further comprising a cheek plate removable from said sleeve module and positionable in one of a plurality available selectable positions relative the sleeve module.

8. A modular gunstock comprising:

a. a weapon interface structure having a cylindrical profile;

b. a sleeve module slideable upon the cylindrical profile, the sleeve module further comprising interface structure for a stock body;

c. structure to fixedly interface the sleeve module and the interface structure;

d. an adjustable for length stock body with a latching mechanism; and e. a length of pull pre-set system, the system comprising a plurality of threaded holes located on an underside of the sleeve module, a stop bolt capable of threadingly interfacing with any of the holes, a spring biased lateral latch with an upwards angular block located on an upper side of the stock body and positioned such that the angular block will strike the stop bolt if the stock body is extended relative to the sleeve module to a point determined by the location of the stop bolt and the latch is in a neutral position, and may be extended beyond said point of the latch is biased so the angular block avoids the stop bolt.

* * * * *